United States Patent [19]

Thomas

[11] 4,032,155

[45] June 28, 1977

[54] SPLIT BOLT AND BLOCK GAME

[76] Inventor: Wesley L. Thomas, 109 S. Catalina, Los Angeles, Calif. 90004

[22] Filed: Mar. 15, 1976

[21] Appl. No.: 666,623

[52] U.S. Cl. ..... 273/156; 35/22 A

[51] Int. Cl.[2] ..... A63F 9/08

[58] Field of Search ..... 273/1 R, 156; 35/22 A, 35/13, 34, 72

[56] References Cited

UNITED STATES PATENTS

| | | | |
|---|---|---|---|
| 610,577 | 9/1898 | Baldwin | 35/72 |
| 1,173,298 | 2/1916 | Montessori | 35/72 |
| 2,623,303 | 12/1952 | Mindel | 35/22 A |
| 3,235,263 | 2/1966 | Smith | 273/156 |
| 3,427,731 | 2/1969 | Debolt | 35/13 |
| 3,479,751 | 11/1969 | Welbourn | 273/1 R X |

*Primary Examiner*—William H. Grieb
*Attorney, Agent, or Firm*—Keith D. Beecher

[57] ABSTRACT

A toy or game is provided which comprises a block which may have cubical or other shape, and which is provided with a multiplicity of tapped holes therein of different diameters. A plurality of split bolts are also provided of different colors, sizes and head shapes, and the object of the game is to fit the proper halves together for each such bolt, to select the proper hole in the block into which the bolt may be fitted, and to screw each of the bolts into the proper hole.

4 Claims, 4 Drawing Figures

SPLIT BOLT AND BLOCK GAME

DETAILED DESCRIPTION OF THE INVENTION

Figure 1:
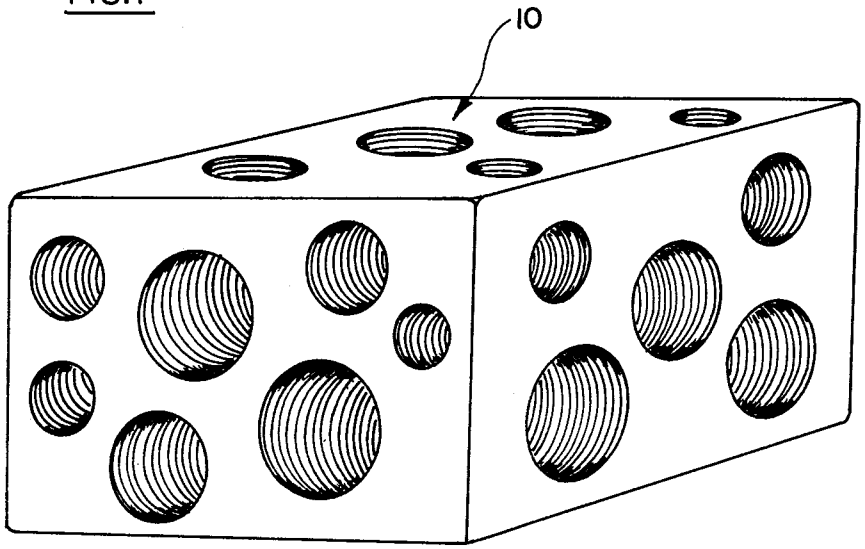
FIG. 1 is a perspective representation of a cubical block having a plurality of tapped holes of different diameters formed in each face thereof.

The block shown in FIG. 1 is designated 10, and is shown as having a cubical shape, although it could have other shapes, such as spherical, polygonal, or the like. Each face of the block of FIG. 1 may be painted a different color. If so desired, the block may be mounted on wheels.

Figure 2:
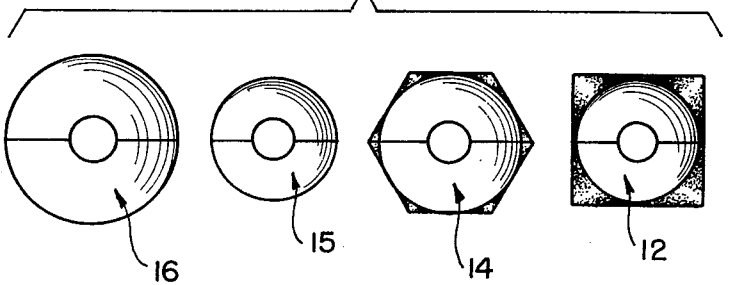
FIG. 2 is a top plan view of a plurality of split bolts of different sizes and head shapes which are adapted to be screwed into different holes in the block 10.

A plurality of split bolts are shown in FIG. 2, and designated 12, 14, 15 and 16 respectively. The bolt 12 has a square head, the bolt 14 has a hexagonal head, and the bolts 15 and 16 each have circular heads. The bolts of FIG. 2 are of different sizes. The heads may be of different colors, so as to provide the player with a color code, if so desired, in fitting the appropriate halves together into the proper bolt. When each bolt is formed, the player then selects the proper hole in the block 10 into which the bolt may be fitted.

Figure 3:
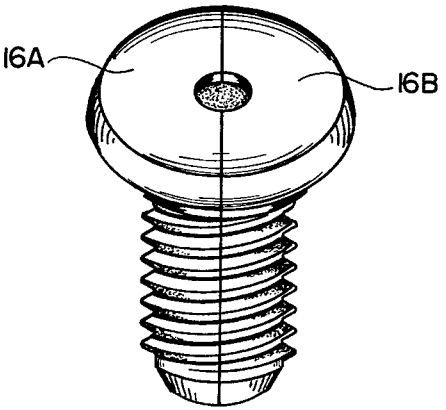
FIG. 3 is a perspective representation of one of the split bolts in FIG. 2, with its two halves assembled.
Figure 4:
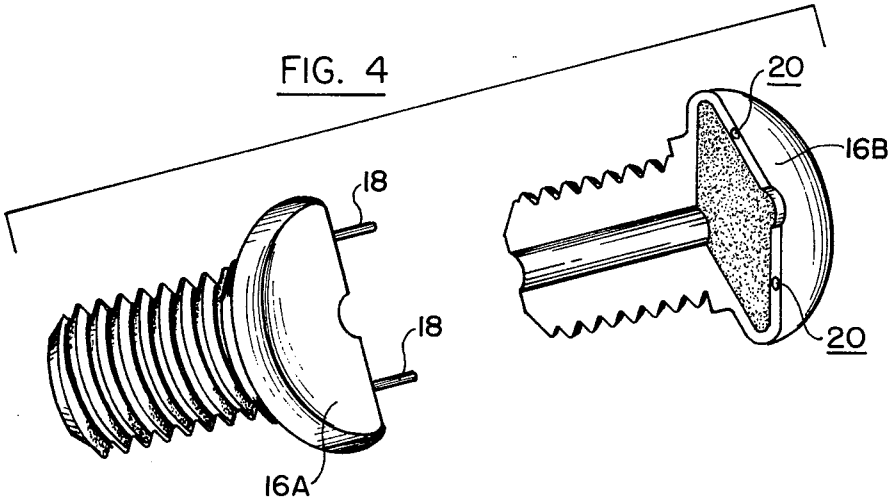
FIG. 4 is a perspective representation of the bolt of FIG. 3, with the halves separated. de

As shown in FIGS. 3 and 4, each of the bolts of FIG. 2, such as the bolts 16, for example, has two halves which are designated 16A and 16B in FIGS. 3 and 4. The two halves 16A and 16B shown in FIG. 4, when placed together form the assembled bolt of FIG. 3, which is now conditioned to be threaded into the proper hole of the block 10 of FIG. 1. Pins 18 are provided in the half 16A which are received in holes 20 in the half 16B to hold the two halves together.

It will be appreciated that while a particular embodiment of the invention has been shown and described, modifications may be made. It is intended in the claims to cover the modifications which come within the spirit and scope of the invention.

What is claimed is:

1. A toy or game comprising: a block having a plurality of tapped holes therein; and a plurality of split bolts, each comprising a plurality of parts adapted to be fitted together to provide a bolt of a size to be received in a corresponding one of the holes in the block.

2. The toy or game defined in claim 1, in which the bolts have different sizes.

3. The toy or game defined in claim 1, in which the bolts each have a head, and the heads have different shapes.

4. The toy or game defined in claim 1, in which the bolts each have a head, and the heads have different colors.

* * * * *